US007640986B2

(12) United States Patent
Behrmann et al.

(10) Patent No.: US 7,640,986 B2
(45) Date of Patent: Jan. 5, 2010

(54) DEVICE AND METHOD FOR REDUCING DETONATION GAS PRESSURE

(75) Inventors: Lawrence A. Behrmann, Houston, TX (US); Brenden M. Grove, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/957,123

(22) Filed: Dec. 14, 2007

(65) Prior Publication Data

US 2009/0151948 A1 Jun. 18, 2009

(51) Int. Cl.
*E21B 29/02* (2006.01)

(52) U.S. Cl. ..... 166/297; 89/7

(58) Field of Classification Search ..... 166/297, 166/55, 55.1; 175/4.54
See application file for complete search history.

(56) References Cited

U.S. PATENT DOCUMENTS

| | | | | |
|---|---|---|---|---|
| 3,054,938 | A * | 9/1962 | Meddick | 102/310 |
| 4,635,733 | A | 1/1987 | Vann et al. | |
| 5,303,633 | A * | 4/1994 | Guthrie et al. | 89/8 |
| 5,355,802 | A | 10/1994 | Petitjean | |
| 5,505,260 | A | 4/1996 | Andersen et al. | |
| 5,551,344 | A | 9/1996 | Couet et al. | |
| 6,336,408 | B1 * | 1/2002 | Parrott et al. | 102/312 |
| 6,598,682 | B2 | 7/2003 | Johnson et al. | |
| 6,874,579 | B2 | 4/2005 | Johnson et al. | |
| 6,966,377 | B2 | 11/2005 | Johnson et al. | |
| 7,036,594 | B2 | 5/2006 | Walton et al. | |
| 7,044,225 | B2 * | 5/2006 | Haney et al. | 166/308.1 |
| 7,121,340 | B2 * | 10/2006 | Grove et al. | 166/297 |
| 7,165,614 | B1 * | 1/2007 | Bond | 166/297 |
| 7,243,725 | B2 | 7/2007 | George et al. | |
| 2005/0173118 | A1 * | 8/2005 | Li et al. | 166/297 |

* cited by examiner

*Primary Examiner*—David J Bagnell
*Assistant Examiner*—James G Sayre
(74) *Attorney, Agent, or Firm*—Kevin Brayton McGoff; James L. Kurka; Tim Curington

(57) ABSTRACT

A perforating gun has a gun carrier extending in a longitudinal direction and a loading tube located within the gun carrier. The loading tube extends in the longitudinal direction and a shape charge is supported by the loading tube. The shape charge has a casing, an explosive, and a liner, the casing opening in a first direction and having a centerline extending in the first direction, the first direction being essentially perpendicular to the longitudinal direction. A liquid implant is located adjacent to the shape charge in the first direction and intersecting the centerline.

22 Claims, 1 Drawing Sheet

DEVICE AND METHOD FOR REDUCING DETONATION GAS PRESSURE

TECHNICAL FIELD

The present application relates to perforating, and more particularly to creating a transient underbalanced condition in connection therewith.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in a casing and to extend perforations into the surrounding formation.

The explosive nature of the formation of perforation tunnels shatters sand grains of the formation. A layer of "shock damaged region" having a permeability lower than that of the virgin formation matrix can form around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One method of obtaining clean perforations is underbalanced perforating, referred by Schlumberger proprietarily as "PURE". The perforating process results in a wellbore pressure which drops rapidly to a value below the formation pressure. This dynamic, or transient underbalance, cleans the perforation damage, thereby improving well performance.

There is a continuing need to improve that process to optimize fluid communication with reservoirs in formations of a well. The present application describes a number of embodiments addressing a number of issues associated therewith.

SUMMARY

An embodiment of the present application is directed to a perforating gun, comprising: a gun carrier extending in a longitudinal direction; a loading tube located within the gun carrier, the loading tube extending in the longitudinal direction; a shape charge being supported by the loading tube, the shape charge having a casing, an explosive, and a liner, the shape charge aiming in a first direction and having a centerline extending along the first direction, the first direction being essentially perpendicular to the longitudinal direction; and a liquid implant, the liquid implant being located adjacent to the shape charge in the first direction and intersecting the centerline.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "uphole", "downhole", "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

U.S. Pat. No. 7,121,340 describes a Method and Apparatus for Reducing Pressure in a Perforating Gun and is incorporated herein by reference in its entirety. As described therein and discussed in the present application, treatment of perforation damage and removal of perforation generated (charge and formation) debris from the perforation tunnels can be accomplished by increasing the local pressure drop (increasing the local transient underbalance).

In operation, a well operator identifies or determines a target transient underbalance condition that is desired in a wellbore interval relative to a wellbore pressure (which may be set by reservoir pressure). The target transient underbalance condition can be identified in one of several ways, such as based on empirical data from previous well operations or on simulations performed with modeling software. The configured control tool string is then lowered to a wellbore interval, where the tool string is activated to detonate explosives in the tool string. Activation causes the target transient underbalanced condition to be achieved.

A major factor in the transient underbalance is hot gas resulting from the shape charge detonation. As gas becomes hot, pressure increases generally according the relationship $PV \propto nRT$. Thus, one way to increase the transient underbalance is to lower the temperature (T) of the hot gas resulting from detonation.

Figure 1:
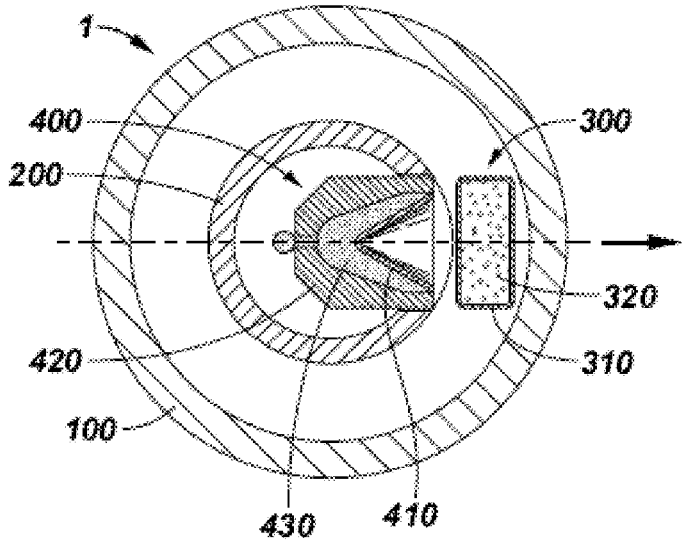
FIG. 1 shows a cross section of an embodiment.
Figure 3:
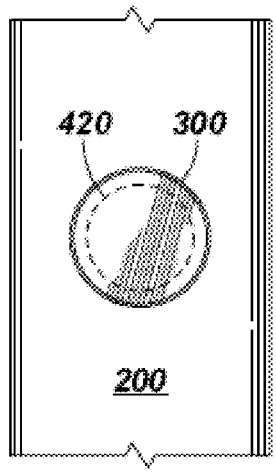
FIG. 3 shows a side view schematic of an embodiment.

FIG. 1 shows a schematic longitudinal cross section of a representative perforating gun 1 that is used in connection with creation of transient underbalanced conditions. A loading member 200 is located inside a gun carrier 100. The loading member 200 supports shape charges 400. The shape charge 400 opens in a first direction and has a centerline (shown) extending in the first direction. The loading member 200 is shown in tube form, but the loading member 200 can take many forms so long as the shape charges are adequately supported and oriented. When the shape charge 400 detonates, explosives 430 that are held between a casing 420 and a liner 410 detonate. The liner 410 is propelled outward in a direction away from the shape charge 400 in the first direction.

Figure 2:
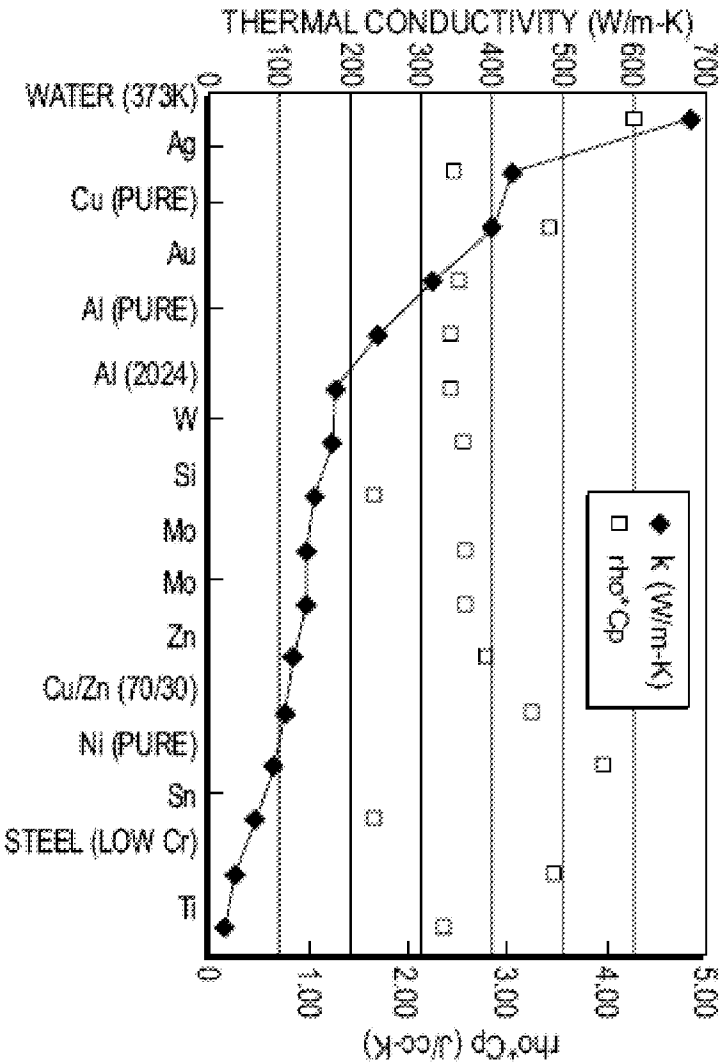
FIG. 2 shows a chart illustrating thermal conductivity of various materials.

A liquid implant 300 is positioned adjacent to the shape charge 400 and intersects the centerline. The liquid implant 300 can be placed in many locations so long as the liquid container is in a path of trajectory of the liner 410 upon detonation, e.g., intersects the centerline. The liquid implant 400 is a container containing liquid. The liquid implant has an outer barrier 310 containing the liquid 320. The barrier 310 can be made from almost any material capable of containing liquid 320 and withstanding down hole conditions. The barrier 310 can be made from metal, glass, ceramics, polymers, plastics or elastomers. The liquid 320 in the barrier 310 can be almost any liquid 320 having the proper thermal conductivity and specific heat capacity. Preferably, water is the liquid 320 because water has particularly good thermal conductivity and specific heat capacity compared to other liquids and materials. FIG. 2 shows a chart illustrating thermal conductivities and specific heat capacities for a number of materials.

After detonation, the liner 410 forms a jet which is propelled into the liquid implant 300 thereby opening the barrier 310 and releasing the contents of liquid implant 300. Preferably, the barrier 310 of the liquid implant 300 is punctured, thereby placing the liquid 320 in contact with both the jet and the hot gasses resulting from the detonation. The jet continues though the gun carrier 100, through the casing 100 and into formation. The liquid 320 in the liquid implant 300 acts as a heat sink thereby cooling the hot gasses and helping create/increase an optimal underbalanced condition.

In operation of an embodiment, as the jet penetrates the gun carrier 100 and the casing 500, the pressure differential between the area outside the gun carrier 100 and inside the gun carrier 100 produces a flow through the holes in the casing 500 into the interior of the casing 500 and the interior of the gun carrier 100. The liquid 320 in the barrier 310 of the liquid implant 300, preferably water, increases cooling of the hot gasses inside the gun carrier 100, thereby increasing the pressure differential between inside the gun carrier 100 and outside the gun carrier 100, thereby increasing the underbalanced condition. Preferably the water is vaporized thereby approaching optimum performance.

The shape charge 400 can have a casing 420, a liner 410 and explosive 430 kept between the casing 420 and the liner 410. The casing 420 can have a generally concave shape and define an inner volume where the explosive 430 is located. The casing 420 opens in a first direction, shown by the arrow in FIG. 1. The first direction can be generally perpendicular to a longitudinal direction that the gun carrier 100 and loading tube 200 extend in. The casing 420 has a rim that forms a perimeter of an opening leading into the interior volume where the explosive 430 is located. The perimeter can be in a circular shape and define a planer area.

The liquid implant 300 is located adjacent to the shape charge 400 in the first direction. The liquid implant 300 is located so that when the shape charge 400 detonates, the liner 410 is propelled in the first direction and contacts the liquid implant 300. The liner 410 strikes the liquid implant 300 and breaks barrier 310 thereby releasing the water 320 contained in the liquid implant 300. The barrier 310 could break without contacting the liner 410, for example, under pressure or heat from the detonation of the shape charge or an alternate mechanism. The liquid implant 300 can be located so that the implant 300 at least partially overlaps the interior planar area defined by the rim 430 in the first direction. The liner 300 can entirely overlap the area defined by the rim 430 in the first direction.

The preceding description relates to certain embodiments and does not in any way limit the scope of the claims recited herein.

The invention claimed is:

1. A perforating gun, comprising:

A gun carrier extending in a longitudinal direction;

a loading tube located within the gun carrier, the loading tube extending in the longitudinal direction;

a shape charge being supported by the loading tube, the shape charge having a cup-shaped casing having a rim that defines an opening to an interior volume of the casing, a liner located inside the casing, and an explosive between the casing and the liner, the shape charge aiming in a first direction and having a centerline extending along the first direction, the first direction being essentially perpendicular to the longitudinal direction; and a liquid implant, the liquid implant being located outside of the interior volume of the cup-shaped casing and adjacent to the shape charge in the first direction and intersecting the centerline;

wherein the liquid implant contains water.

2. The perforating gun of claim 1, wherein the outer rim forms a perimeter defining an interior area of the perimeter in the first direction, the liquid implant overlapping the entire inside area of the perimeter in the first direction.

3. The perforating gun of claim 1, wherein the liquid implant overlaps the interior area of the perimeter in the first direction and extends outside the interior of the perimeter uphole in the longitudinal direction.

4. The perforating gun of claim 1, wherein the liquid implant overlaps the interior area of the perimeter in the first direction and extends outside the interior area of the perimeter downhole in the longitudinal direction.

5. The perforating gun of claim 1, wherein the liquid implant overlaps the interior area of the perimeter in the first direction and extends outside the interior area of the perimeter uphole and downhole in the longitudinal direction.

6. The perforating gun of claim 1, wherein the liquid implant is positioned adjacent to the shape charge so that when the shape charge detonates the liner is propelled into contact with the liquid implant.

7. The perforating gun of claim 1, wherein the liquid implant has a barrier that defines an internal area, the internal area containing liquid.

8. The perforating gun of claim 7, wherein the barrier defines a single internal area in the liquid implant.

9. A method of perforating, comprising:

placing a perforating gun downhole, the perforating gun comprising:

a gun carrier extending in a longitudinal direction;

a loading tube located within the gun carrier, the loading tube extending in the longitudinal direction;

a shape charge being supported by the loading tube, the shape charge having a cup-shaped casing having a rim that defines an opening to an interior volume of the casing, a liner within the casing and an explosive between the casing and the liner, the shape charge aiming in a first direction, the first direction being essentially perpendicular to the longitudinal direction; and a liquid implant, the liquid implant being located outside of the interior volume of the cup-shaped casing and adjacent to the shape charge in the first direction;

wherein the liquid implant contains water;

the method comprising, detonating the shape charge thereby forming the liner into a jet, the jet being propelled in the first direction thereby contacting and rupturing the liquid implant and releasing liquid in the liquid implant, thereby contacting the liquid with gas produced from the detonation of the shape charge.

10. The method of claim 9, wherein the shape charge has a centerline extending in the first direction, the liquid implant intersecting the centerline.

11. The method of claim 9, wherein the shape charge has a centerline extending in the first direction, the liquid implant surrounding the centerline.

12. The perforating gun of claim 1, wherein the liquid implant is made from plastic.

13. The perforating gun of claim 1, wherein the liquid implant is made from metal.

14. The perforating gun of claim 1, wherein the liquid implant is made from polymer.

15. The perforating gun of claim 1, wherein the liquid implant is ceramic.

16. The perforating gun of claim 1, wherein the liquid implant is made from elastomer.

17. The perforating gun of claim 9, wherein the liquid implant has a barrier that defines an internal area, the internal area containing liquid.

18. The perforating gun of claim 17, wherein the barrier defines a single internal area in the liquid implant.

19. A perforating gun, comprising:

a gun carrier extending in a longitudinal direction;

a loading tube located within the gun carrier, the loading tube extending in the longitudinal direction;

a shape charge being supported by the loading tube, the shape charge having a cup-shaped casing having a rim that defines an opening to an interior volume of the cup-shaped casing, a liner inside the casing, and an explosive located between the casing and the liner, the shape charge aiming in a first direction, the first direction being essentially perpendicular to the longitudinal direction; and a liquid implant, the liquid implant being located outside of the interior volume of the cup-shaped casing and adjacent to the shape charge in the first direction and intersecting the centerline and poisoned so that upon detonation of the shape charge the liner becomes a jet, the jet being projected into contact with the liquid implant;

wherein the liquid implant contains water.

20. The perforating gun of claim 19, wherein the liquid implant is a container having a single interior volume holding liquid.

21. The perforating gun of claim 19, comprising at least one shape charge and only one liquid implant corresponding to each of the at least one shape charge.

22. The perforating gun of claim 20, comprising at least one shape charge and only one liquid implant corresponding to each of the at least one shape charge.

* * * * *